United States Patent [19]

Hughes et al.

[11] Patent Number: 4,987,706

[45] Date of Patent: Jan. 29, 1991

[54] CONTROLLED-ENVIRONMENT ENTERTAINMENT CENTER

[76] Inventors: William E. Hughes; Pamela K. Hughes, both of 238 N. 29th, Cornelius, Oreg. 97113

[21] Appl. No.: 311,816

[22] Filed: Feb. 17, 1989

[51] Int. Cl.[5] ..... E04H 1/12

[52] U.S. Cl. ..... 52/79.5; 52/79.1; 52/143

[58] Field of Search ..... 181/30; 52/79.1, 79.5, 52/143, 6, 8, 9

[56] References Cited

U.S. PATENT DOCUMENTS

| | | | |
|---|---|---|---|
| 3,118,187 | 1/1964 | Alimanestiano | 52/143 |
| 3,233,935 | 2/1966 | Brindle | 52/143 |
| 3,923,134 | 12/1975 | Regazadeh | 52/79.1 |

*Primary Examiner*—Michael Safavi

*Attorney, Agent, or Firm*—William D. Haffner

[57] ABSTRACT

A controlled-environment entertainment system comprising a reclining chair entirely enclosed in a soundproof rectangular enclosure, an audio-visual entertainment system, and a ventilation system. The enclosure is constructed of two modules arranged for quick disengagement. Retractable wheels on the enclosure provide an added measure of mobility.

2 Claims, 2 Drawing Sheets

CONTROLLED-ENVIRONMENT ENTERTAINMENT CENTER

BACKGROUND OF THE INVENTION

The present invention relates generally to entertainment centers, and more particularly, controlled-environment entertainment centers.

Prior systems consist primarily of partially enclosed chairs either with built-in speakers and stereo systems. U.S. Pat. No. 3,762,767 granted to Powell describes a partially enclosed chair with built-in tape recorder, lights, and speakers. The speakers may be used in the interior of the chair or they may be swung outward to provide sound to those exterior to the chair. U.S. Pat. No. 4,124,249 granted to Abbeloos discloses a reclining chair that contains a large speaker mounted in a chamber formed under the thorax area of a person resting on the chair. A pair of arcuate members are mounted on the chair at the person's head and have four distinct loudspeaker chambers enclosed therein for directing multichannel or single channel sound into the ears of the person.

SUMMARY OF THE INVENTION

In accordance with the preferred embodiment of this invention, a controlled-environment entertainment system is entirely enclosed, sound proof, and mobile.

Basically, according to the present invention a controlled-environment entertainment system comprises a substantially rectangular enclosure with a reclining chair mounted therein. Access to the interior of the enclosure is gained through a hingeably mounted door. Included in the enclosure are also an audio-visual entertainment system, a reading light, and a ventilation system. Sound speakers are mounted on both the interior and the exterior of the enclosure to accomodate listeners inside and outside the entertainment center. Modular construction and retractable wheels provide the entertainment system with a high degree of mobility.

It is a primary object of this invention to provide an entertainment center that has a controlled environment.

It is a further object of this invention to provide an entertainment system that offers a comfortable and relaxing environment.

It is another object of this invention to provide a controlled-environment entertainment center that is mobile.

It is still another object of this invention to provide a controlled-environment entertainment center that is an attractive article of furniture.

The subject matter of the present invention is particularly pointed out and distinctly claimed in the following description. The invention, however, both as to organization and method of operation together with further advantages and objects thereof may be best understood be reference to the following description taken in conjunction with the accompanying drawings wherein like reference numerals refer to like elements. It is to be understood that this embodiment is not intended to be exhausting nor limiting of the invention but is for the purpose of illustration in order that others skilled in the art may fully understand the invention and principles thereof and the manner of applying it in a particular use so that they may modify it in various ways, each as may best be suited to the conditions of the particular use.

DESCRIPTION OF THE PREFERRED EMBODIMENT

Figure 1:
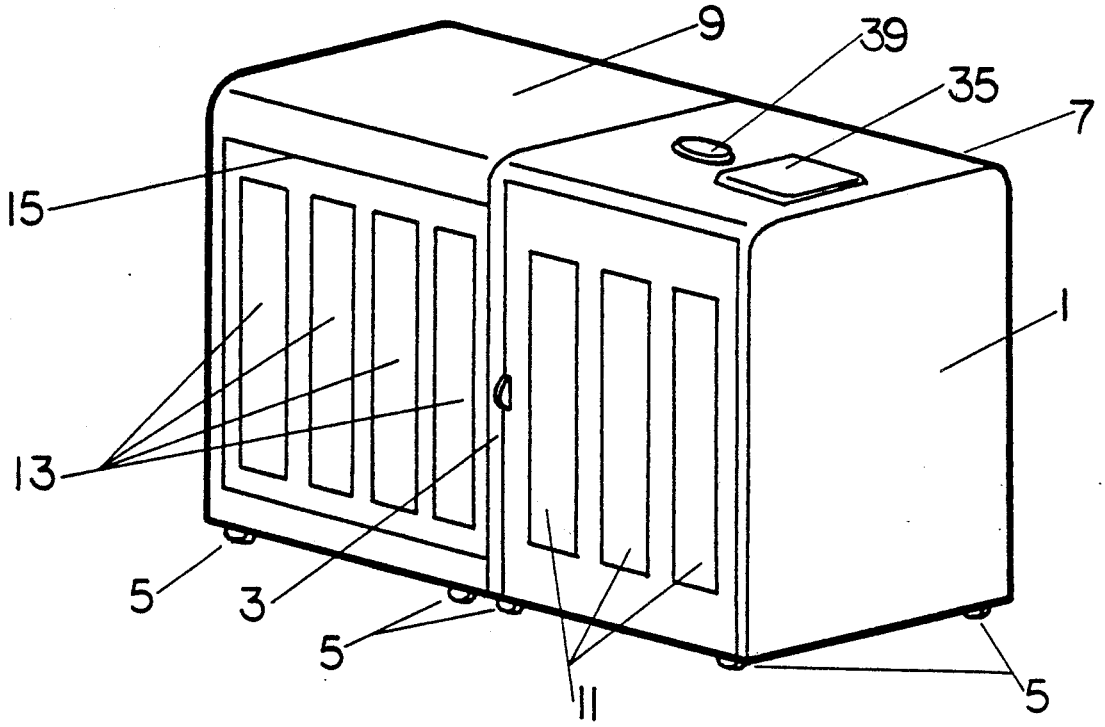
FIG. 1 shows an exterior view of the preferred embodiment of the present invention.
Figure 2:
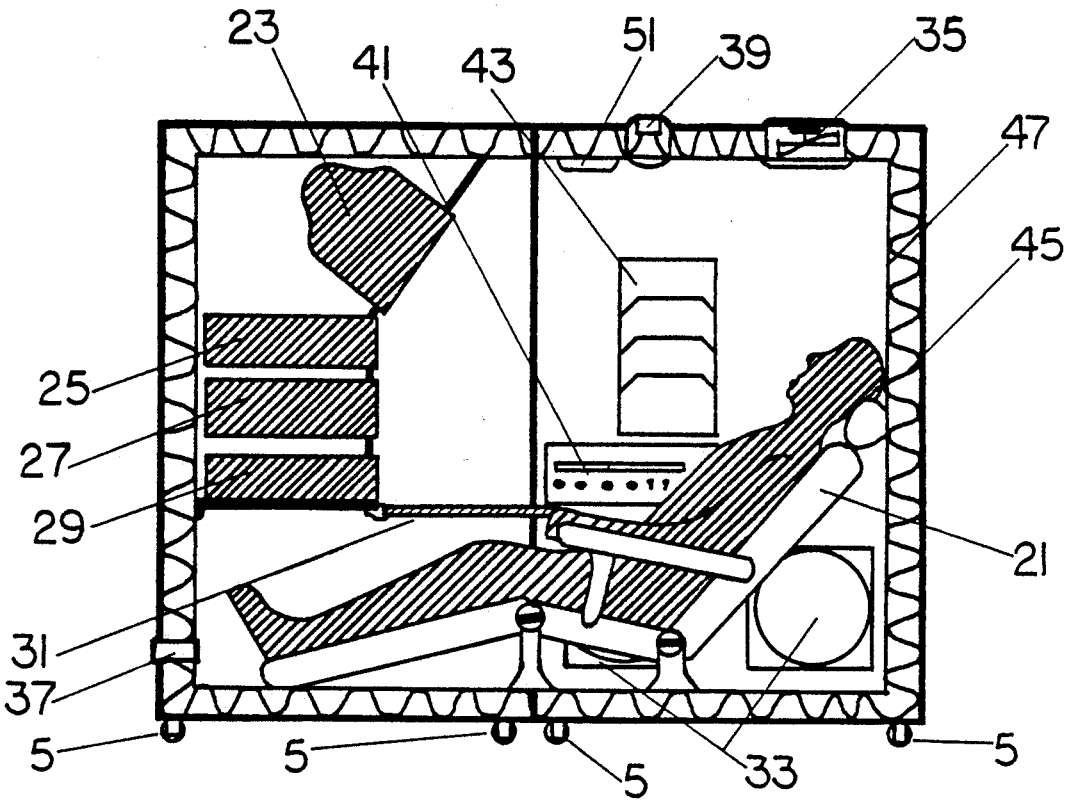
FIG. 2 shows one view of the interior of the preferred embodiment of the present invention.
Figure 3:
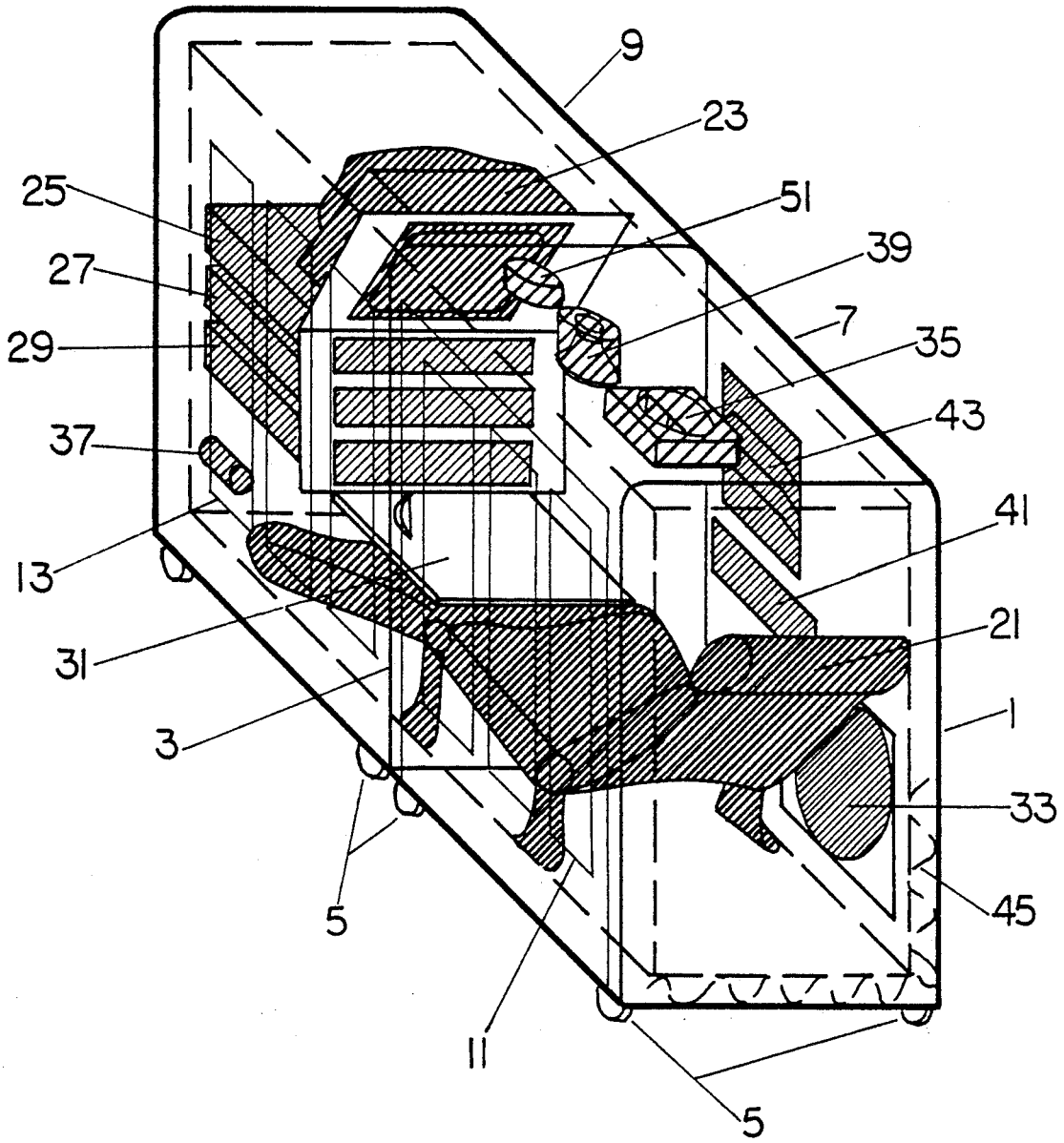
FIG. 3 is another view of the interior of the preferred embodiment of the present invention.

Referring now to FIGS. 1-3, a controlled-environment entertainment center according to the present invention comprises an enclosure 1 with a door 3 on one side thereof to provide access to the interior of enclosure 1. Enclosure 1 is substantially rectangular in shape. The outer surface of enclosure 1 is paneled with decorative paneling, for example, wood-grained Formica. Any number of decorative paneling materials are suitable according to this invention. The interior surface of enclosure 1 is covered with sound-absorbing material 45 such as fiber glass which may be two inches thick. Any number of sound-absorbing materials are suitable according to this invention. Inner shell 47 covers sound-absorbing material 45. Inner shell 47 consists, preferably, of decorative paneling or carpeting. Various coverings are suitable according to the present invention.

To provide portability, a controlled-environment entertainment center according to the present invention has retractable wheels 5 mounted on the bottom surface thereof. Retractable wheels 5 may be hydraulically or otherwise actuated from the exterior of enclosure 1. To provide additional mobility, enclosure 1 is constructed so as to be easily divided into front portion 9 and rear portion 7, as shown in FIG. 1. Preferably, the front and rear portions of enclosure 1 are arranged for quick disengagement including the electrical and sound wiring passing therebetween. When enclosure 1 is separated into its two parts, it may be more easily maneuvered through doorways and the like. Once in a new location, the front and rear portions of enclosure 1 may be quickly reconnected.

Door 3 which is hingeably attached to one side of rear portion 7 of enclosure 1 contains windows 11 which consist, preferably, of uni-directional viewing material such as smoke-colored Plexiglas. Any number of unidirectional viewing materials are suitable according to the present invention. Windows 11 allow the occupant of an entertainment center according to the present invention to observe activities outside enclosure 1 while maintaining privacy. Windows 11 also offer some relief to those occupants who may suffer from mild cases of claustrophobia.

Mounted on the exterior surface of front portion 9 of enclosure 1 are sound speakers 13. Preferably, sound speakers 13 are covered by removable panel 15 when not in use. Speakers 13 may be switched on and off by the occupant of the entertainment center. Speakers 13 may play music, in cooperation with stereo system 25 mounted inside enclosure 1, or television audio, in cooperation with television 23, for the enjoyment of those outside the enclosure.

Mounted inside rear portion 7 of enclosure 1 is chair 21. Chair 21 is preferably a reclining chair with head, arm, and foot rests as shown in FIG. 2. The arm rest on chair 21, preferably swings upward and out of the way to provide the occupant easy entry to the chair.

Directly in front of chair 21 and mounted in front portion 9 of enslosure 1 is an audio-visual entertainment system. The audio-visual entertainment system consists, preferably, of television 23 which is rotatibily mounted so as to provide viewing from various angles within enclosure 1, stero system 25, and, optionally, video cassette recorder 29. Any combination of these components or other additional audio-visual entertainment components is suitable according to the present invention. Drawer 27 is provided to hold such items as audio and video cassettes and the like. Mounted below the audio-visual entertainment system is shelf 31. Shelf 31 is swingably mounted so that it can be moved to within easy reach of a seated occupant or swung out of the way under the audio-visual entertainment system. Shelf 31 may be used by the occupant to hold various diverse items such as food, typewriters, or computer Keyboards. Sound speakers 33 are mounted on the lower interior walls of rear portion 7 of enclosure 1. These speakers may play music, in cooperation with stereo system 25, or television audio, in cooperation with television 23.

Fan 35 and air intake 37 are provided to supply fresh air to the occupant. Fan 35 should be preferably connected so as to turn on when door 3 is closed. Reading light 39 is mounted on the interior surface of rear portion 7 of enclosure 1 above a seated occupant's head.

Alarm/detector 51 is mounted in the ceiling of enclosure 1 to detect smoke or high temperature within the enclosure. Alarm/detector 51, preferably, provides both an audible and visible alarm for protection of the occupant.

Controls for reading light 39 and the audio-visual entertainment system are contained in control panel 41 mounted on the right side of the interior surface of rear portion 7 of enclosure 1. It is preferred that control panel 41 be mounted within easy reach of a seated occupant.

Mounted above control panel 41 is magazine/book rack 43 which is preferably located within easy reach of a seated occupant.

It may be observed in the foregoing specification that such specification is not burdened by the inclusion of large amounts of detail and specific information relative to such matters as construction and wiring and the like since all such information is well within the skill of the art. It should also be noted that the particular embodiment of the invention which is shown and described herein is intended as merely illustrative and not as restrictive of the invention. Therefore, the appended claims are intended to cover all modifications to the invention which fall with the scope of the foregoing specification.

We claim as my invention:

1. A controlled-environment entertainment center comprising:

(a) an entirely enclosed sound-proof enclosure;

(b) a reclining chair mounted in said sound-proof enclosure;

(c) an audio-visual entertainment system mounted in said sound-proof enclosure;

(d) a door in the side of said sound-proof enclosure for convenient access to the interior thereof;

(e) decorative paneling or the like covering the exterior of said sound-proof enclosure; and (f) sound speakers mounted on the exterior of said sound-proof enclosure for playing music or television audio in cooperation with said audio-visual entertainment system.

2. A portable controlled-environment entertainment center comprising:

(a) an entirely enclosed sound-proof enclosure, said enclosure being comprised of two modules;

(b) a reclining chair mounted in said sound-proof enclosure;

(c) and audio-visual entertainment system mounted in said sound-proof enclosure;

(d) a door in the side of said sound-proof enclosure for convenient access to the interior thereof;

(e) decorative paneling or the like covering the exterior of said sound-proof enclosure;

(f) sound speakers mounted on the exterior of said sound-proof enclosure for playing music or television audio in cooperation with said audio-visual entertainment system; and (g) multiple wheels mounted on the bottom surface of said sound-proof enclosure.

* * * * *